US005299374A

United States Patent [19]

Mathys

[11] Patent Number: 5,299,374

[45] Date of Patent: Apr. 5, 1994

[54] MULTIFUNCTION FIRE ARM CONTROL DEVICE

[76] Inventor: Georges Mathys, Moulin de l'Estrille, 3320 Tizac De Curton, France

[21] Appl. No.: 923,455

[22] Filed: Aug. 3, 1992

[30] Foreign Application Priority Data

Aug. 7, 1991 [FR] France ..... 91 10251

[51] Int. Cl.[5] ..... F41A 19/35

[52] U.S. Cl. ..... 42/69.01; 89/147

[58] Field of Search ..... 42/69.01, 69.02, 69.03; 89/147

[56] References Cited

U.S. PATENT DOCUMENTS

| | | | |
|---|---|---|---|
| 4,937,964 | 7/1990 | Crandall | 42/69.03 |
| 5,050,480 | 9/1991 | Knight et al. | 89/147 |
| 5,086,578 | 2/1992 | Lishness et al. | 42/69.02 |
| 5,135,151 | 8/1992 | Logan | 42/69.01 |

FOREIGN PATENT DOCUMENTS

| | | |
|---|---|---|
| 605727 | 10/1934 | Fed. Rep. of Germany . |
| 2562653 | 10/1985 | France . |

*Primary Examiner*—David H. Brown

*Attorney, Agent, or Firm*—Sandler Greenblum & Bernstein

[57] ABSTRACT

The invention concerns a multifunctional firearm control device comprising: (A) a trigger slidably-mounted on the casing of the firearm and able to occupy four positions, namely the first position, comprising a rest or uncocked position, the second comprising an armed position situated behind the first position, and a third position comprising the firing position situated behind the second position, and finally a fourth position comprising an opening position situated in front of the rest position; (B) a triggering device with meeting roller bearings and a percussion spring which, once freed, activates a cock, hammer or striking pin; (C) a firing plate including an armament ramp moved by the trigger activation, via a non-reversible movement after armament by means of a roller bearing, an armament lever of the percussion spring and a device for freeing the triggering device with meeting roller bearings; and (D) a control rod moved as the trigger moves into the opening position and, depending on the type of firearm, controlling the opening of the firearm or unlocking of the barrel or freeing of the magazine.

27 Claims, 6 Drawing Sheets

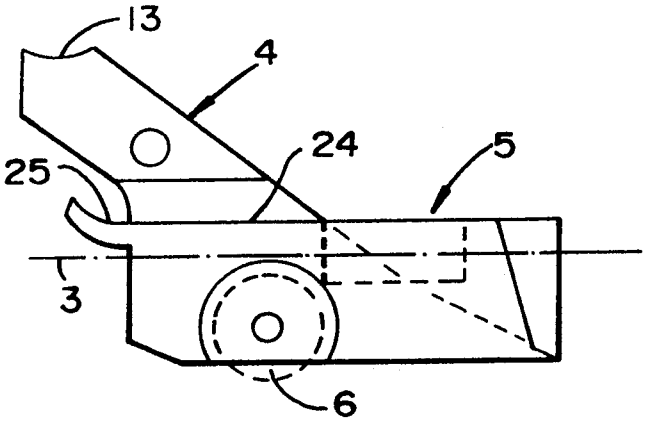
FIG. 3
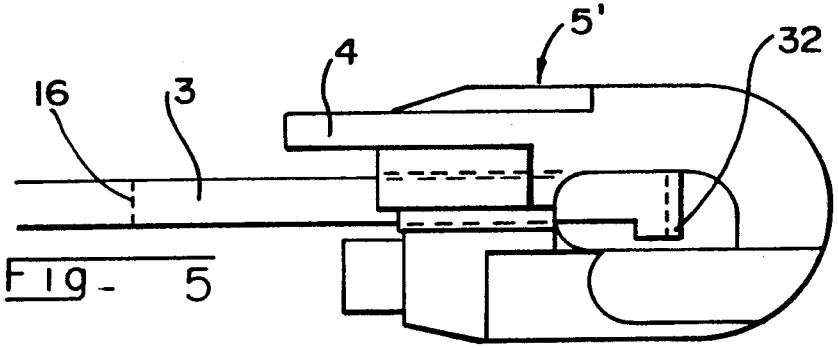
FIG. 5
FIG. 6
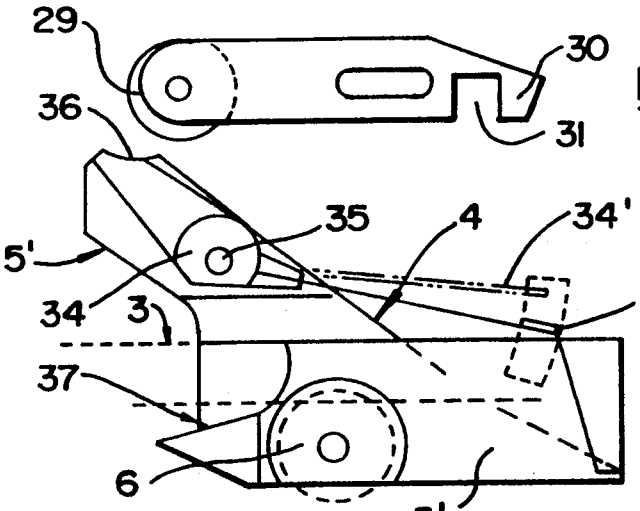
FIG. 4
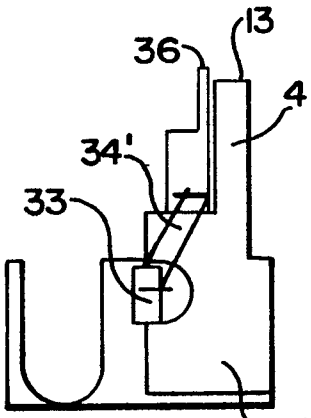
FIG. 7

MULTIFUNCTION FIRE ARM CONTROL DEVICE

FIELD OF THE INVENTION

The present invention concerns a firearm control device which is able, via a sole control member, to carry out the various operations of a firearm, namely, depending on the type of firearm: armament, disarmament, opening, closing, locking of the arm, and opening of the barrel or extraction of the magazine.

BACKGROUND OF THE INVENTION

Currently, in order to function, a firearm, such as a revolver, required a trigger, a cock and a lever for opening the barrel. A single-barrel firearm requires a trigger, an opening lever, a cock, and a safety control.

SUMMARY OF THE INVENTION

An object of the present invention is to provide a firearm control device combining, on the trigger, the functions of a trigger, an opening lever, a cock, and a safety control.

To this effect, the invention concerns a multifunctional firearm control device comprising:

(A) a trigger slidably-mounted on the casing of the firearm, the trigger being able to occupy four positions:
  i) a first position comprising a rest or uncocked position, R;
  ii) a second position comprising an armed position, A, located behind the first position;
  iii) a third position comprising a firing position, T, located behind the second position; and
  iv) a fourth position comprising an opening position, O, located in front of the rest position, R;

(B) a triggering device comprising two meeting roller bearings, and a percussion spring which, once freed, activates a cock, hammer or striking pin;

(C) a firing plate including an armament ramp moved by the trigger activation, via a non-reversible movement after arming by means of a roller bearing, an armament lever of the percussion spring, and a device for freeing said triggering device with meeting roller bearings; and (D) a control rod moved by the trigger as the trigger moves into the opening position and, depending on the firearm type, controlling the opening of the firearm or an unlocking of a barrel or freeing of a magazine.

This type of firearm control device allows for the instantaneous arming or uncocking of the plate with meeting roller bearings by means of the trigger, as well as opening of the firearm, tilting of the barrel of a revolver or the ejection of the magazine of an automatic repetition pistol, automatic pistol or rifle and machine gun, without an other control. This renders it extremely easy to use a firearm and, owing to this, increases safety.

BRIEF DESCRIPTION OF THE DRAWINGS

Other characteristics and advantages of the invention appear more readily from the following description, given solely by way of example, of embodiments of the device of the invention, with reference to the accompanying drawings on which:

FIG. 3 illustrates a first embodiment of an armament ramp according to the present invention;

FIG. 4 illustrates a second embodiment of an armament ramp with a "stecher";

FIG. 5 is a top view of the device of FIG. 4;

FIG. 6 is a side view of a control rod driven by the trigger of the device of FIG. 5;

FIG. 7 is a righthand view of the device of FIG. 4;

DETAILED DESCRIPTION OF THE PREFERRED EMBODIMENTS

Figure 1:
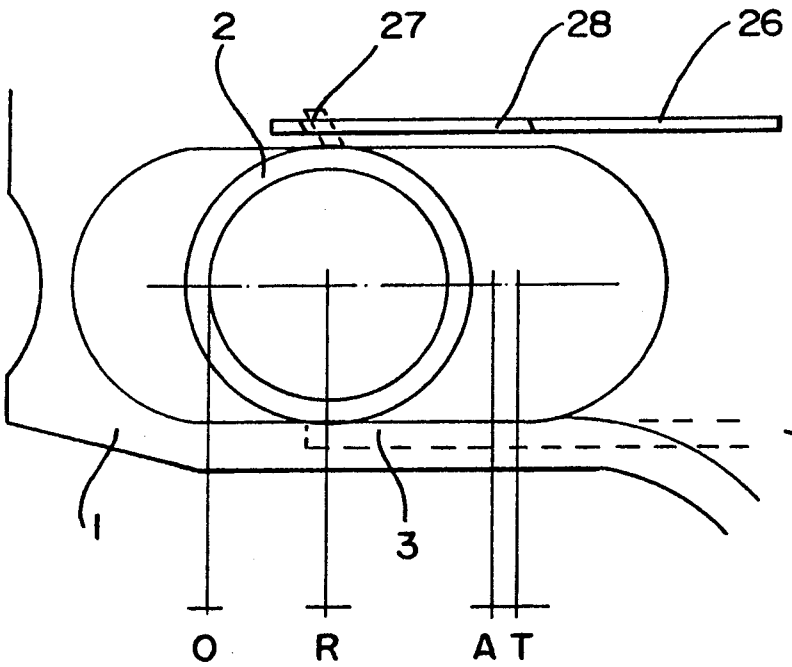
FIG. 1 illustrates a first embodiment of a trigger according to the present invention.

FIG. 1 illustrates at 1 and extended tripper guard of a firearm, such as a pistol, whose barrel is directed leftwards as shown in FIG. 1.

An annular piece 2 is able to slide parallel to the axis of the barrel, said piece constituting the trigger of the firearm according to a first embodiment.

The annular trigger 2 is illustrated in its rest, or uncocked position, R, close to a center position in a trigger guard 1.

In accordance with the invention, the annular trigger 2 is able to occupy a second position A, referred to as the armed position, located behind the rest position R, and a third position T, referred to as the firing position, located slightly behind the armed position A, the trigger 2 being at a back extremity of the trigger guard 1. Finally, trigger 2 can occupy a fourth position, O, referred to as the opening position, situated in front of the rest position R, the trigger 2 being at the front extremity of the trigger guard 1.

Figure 2:
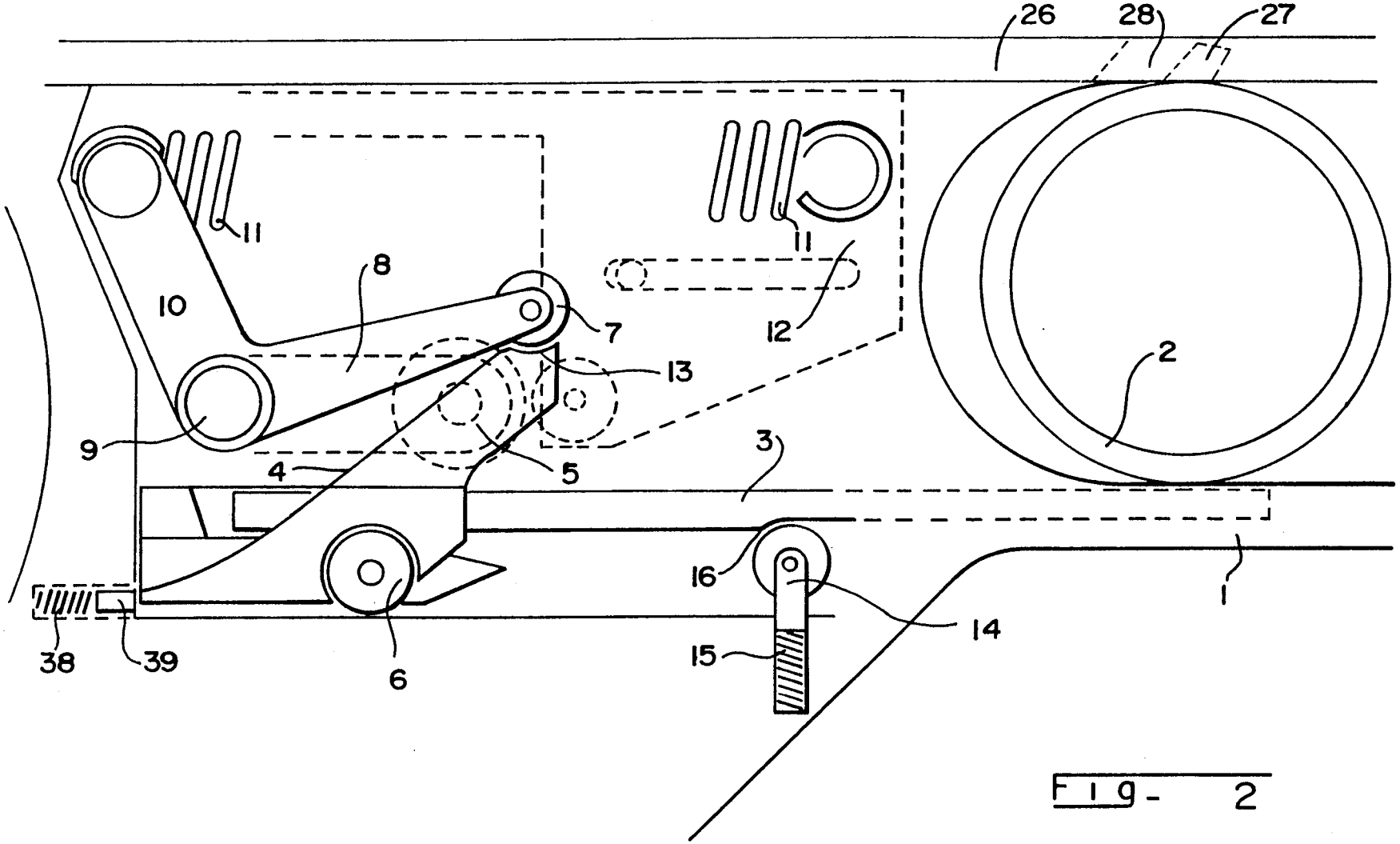
FIG. 2 illustrates a firing plate according to the present invention.

In FIG. 2, the annular trigger 2 is shown in the armed position A. It activates, via a control rod 3, a firing plate including an armament ramp 4 formed on a mobile piece 5 integral with the rod 3 and rolling on a flat surface of a casing of the firearm by means of armament ball bearings 6.

A ball bearing 7 is able to roll on ramp 4, the ball bearing being mounted at the extremity of a lever 8 joined to a spindle 9 integral with the casing of the firearm, and extended by a lever 10 secured to one of the extremities of a percussion spring 11, the other extremity of which is anchored to a cock control 12.

Fitted at the top of the armament ramp 4 is a concave surface 13 forming a non-return pocket to house the ball bearing 7 in either direction.

Alternatively, the concave surface 13 could be replaced by a flat surface preceded, at a level of the junction point, with the armament ramp 4, by a projection forming a non-return pocket or retainer for the roller bearing 7. Furthermore, the flat piece need not be preceded by the non-return pocket or retainer, if retaining is effected with the aid of a roller bearing 14 pressed by a spring 15 against the rod 3, so as to abut against a projection 16 fitted on the rod 3 at the appropriate location.

Associated with the cook control 12 (FIG. 8) is a triggering device with two meeting roller bearings of the type described in the French Patent No. 84 05667, in the name of the applicant of the present invention. This triggering device (illustrated in FIG. 8, but not illustrated in FIG. 2) includes a lever 17 joined at one extremity to a spindle 9 integral with the casing of the firearm, the spindle bearing at its other extremity a roller bearing 19 in contact with a roller bearing 20 integral with the cock control 12 or a striking pin.

The cock control 12 slides parallel to the rod 3 by virtue of an elongated slot 21 therein. The cock control 12 is supported and guided by a shouldered screw pin 22 integral with the casing of the firearm. The cock control 12 is recalled by a spring on the cock (not illustrated) in a rest position (R).

FIG. 3 illustrates an armament ramp 4, fitted on a mobile piece 5 comprising a flat support face 24 for keeping the roller bearing 19 in the armed position. The mobile piece 5 of FIG. 3 is not illustrated in FIGS. 2 and 8. The face 24 of the mobile piece 5 is extended by an upwardly bent ramp 25 directed towards the roller bearing 19 and, during the backward movement towards the left of the rod 3 and the mobile piece 5, lifts up the roller bearing 19 so as to free the roller bearing 20 and the cock control 12. The roller bearing 19 is located at the height of the ramp 25 when the ball bearing 7 is located on the concave surface 13, that is in the armed position A of the annular trigger 2, as illustrated in FIGS. 2 and 8.

When the trigger moves from the rest position, R, to the opening position, 0, a control rod 26 is driven solely by the annular trigger 2 (FIG. 1) controls opening of the arm or unlocking of the barrel or freeing of the magazine pin, according to the type of firearm, by means of a suitable device. To this effect, the trigger 2 comprises a mobile snug 27 in a slot 28 provided in the rod 26, the length of the rod 26 corresponding to the distance between the positions R and T.

In the rest position, R, the roller bearing 7 is at the bottom of the ramp 4 and the percussion spring 11 is not stretched.

Figures 8, 9A, 9B:
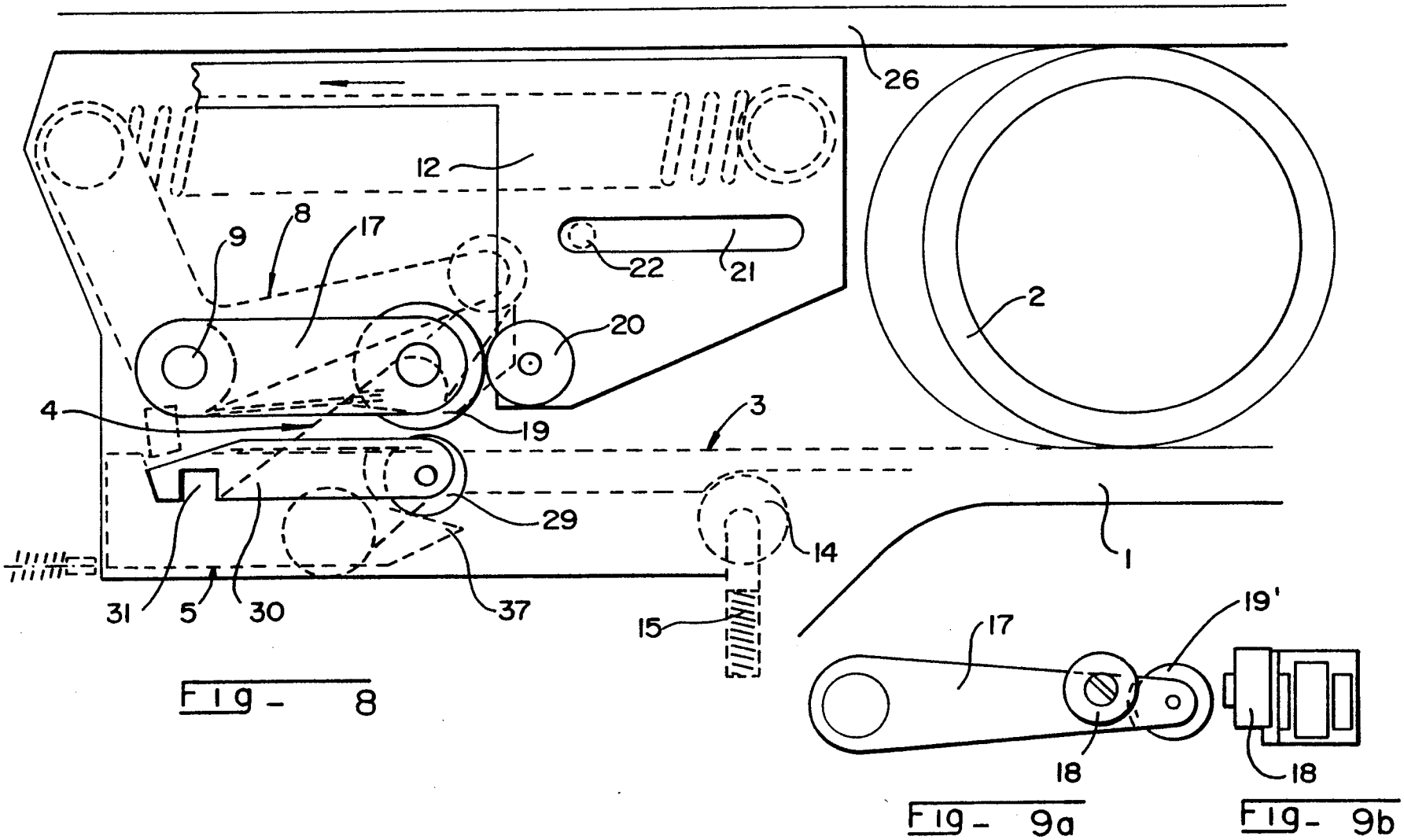
FIG. 8 is a view similar to FIG. 2 completed by the trigger with meeting roller bearings.
FIGS. 9*a* and 9*b* show one embodiment variant of the triggering device with meeting roller bearings.

In the armed position, i.e., position A, of the annular trigger 2, as illustrated in FIGS. 2 and 8, the roller bearing 7 is retained inside the hollow space 13, the percussion spring 11 is stretched, and the cock control 12 and the triggering device with meeting roller bearings 17 to 20 are in the position as shown in FIG. 8. The firing system is activated. This action corresponds to the lifting of the cock on a conventional firearm, namely to the first part of the action on the trigger of a twin-action functioning firearm.

The firing position T of the trigger 2 may immediately follow bringing the trigger into the armed position A via a continuous action of the firer, that is "double action" firing being divided into two clearly distinct actions separated by a longer or shorter time, namely single action firing. As long as the firearm has not been fired, it may instantaneously be disarmed by pushing the trigger forward towards the front, to the resting position R. This action is quite safe, the shot not being able to be fired accidentally as on a conventional arm where the cock freed by the trigger may accidentally escape from the thumb of the firer. In modern arms, a lever, known as a disarming lever, avoids this drawback but generates an additional control.

At the firing position T, the mobile piece 5 is slightly pushed leftwards by the rod 3 as illustrated in FIGS. 2 and 8, so that the cock control 12 is freed by the ramp 25, which causes the roller bearing 19 to move up above a line joining the spindle 18 to the axis of the roller bearing 20. The percussion spring 11 may thus be slackened, the cock control 12 moving towards the left.

Once a shot has been fired, the recall spring of the cock pushes back the control 12 towards the front, the lever 8, 10 lowers again, either via gravity or with the aid of a possible recall spring into the bottom position; a thrustor 39 activated by a spring 38 assists in making the piece 5 return forwards to the resting position R. The cycle returns to its starting position.

The movement of the trigger 2 from the resting position R to the armed position A again causes the ramp 4 to be lifted up, again by the roller bearing 7, as far as the concave surface 13.

The frontward movement of the trigger 2 to the opening position O results in the control rod 26 moving forward over the same distance.

Note that when the percussion spring 11 is stretched, the ball bearing 7 is supported by a concave surface perpendicular to its support, so that the compression exerted by the spring 11 is not reversible on the rod 3. This reduces the force required to move the rod at the resistance of the roller bearing(s). It is not necessary to exert pressure on the trigger 2 so as to maintain arming. Furthermore, the fact of pushing back the trigger 2 towards the front instantly uncocks the arm once the ball bearing 7 has returned onto the ramp 4, returning the trigger 2 to the rest position R. This may be effected even if the firing process has been engaged so long as a shot has not be fired. A concave surface 13 having the same radius of curvature as that of the ball bearing 7 limits the return towards the rear of the ramp 4 and constitutes a "latching," to be freed from the start of the shot.

Note also that by fixing the spindle 9 of the lever 8 to the chamber of an automatic pistol and not to the casing, the ramp immobilized by the latching remains immobile, the lever 8 moves back with the chamber, moves forward with the latter and operates the automatic rearmament of the system, the relative movements of the elements 4 and 7 being identical but with the origin inverted. In this case, the armament of the percussion spring and thus of the cock is only carried out if the trigger is in the "armed" position. The cock or rather the hammer, since it is solely controlled by the trigger, is in the same armed and rest position, that is, lifted up. For percussion, the force on the trigger 2 is continued, the ramp 4 moves backwards, and the firing ramp 25 lifts up the retaining roller bearing 19, which frees the spring 11. In this automatic version, a conventional disengaging system needs to be inserted to as to avoid any burst of firing.

FIG. 4 and 7 illustrate another embodiment of the piece 5 bearing the armament ramp 4.

The piece 5' shown in these Figures and bearing the ramp 4 comprises a device known as a stecher, which is intended to provide the trigger 2 with a light start weight and yet still ensures safety.

This stecher device replaces the support face 24 and the ramp 25 of FIG. 3 and includes a roller bearing 29 borne by a lever 30, these two elements also being shown in FIG. 8. The lever 30 is connected with the extremity of the rod 3 by a notch 31 cooperating with a lateral projection 32 of the rod 3.

The extremity of the rod 3 comes into contact with a retractable stop 33 which may be effaced by means of a tilter lever 34 joined at 35 to the piece 5' with its other extremity being provided with a concave surface 36 slightly higher than the concave surface 13.

When the rod 3 moves to the armed position A, the ball bearing 7 also arrives in the concave surface 36 and tilts the lever 34 which tends to lift up the stop 33 by means of the spring plate 34'. The spring plate 34' is deflected but is unable to lift up the stop 33 as long as pressure is exerted on the trigger. This constitutes protection against any ill-timed starting. The moment the pressure from the firer on the trigger ceases, the stop 33 is no longer jammed by 32 and the spring plate 34' lifts up the stop 33 which frees the rod 3. By means of additional pressure from the firer, the rod 3, and thus the unit 29-30, are able to move backwards with respect to the piece 5' when the trigger 2 moves from the armed position A to the firing position T. The roller bearing 29 then climbs up along a bent inward ramp 37 (also shown in FIG. 8) matching the piece 5', and provokes the lifting up of the roller bearing 19 and thus freeing the cock control 12.

In this embodiment, although there is virtually no friction, there remains resistance to rolling. The armament ramp 4 and its support 5 remain immobile. The quality of starts is incomparable with respect to any existing arm. The ball bearings 19, 20 and 29 are in fact used in a new way by making one roll against the other, or making them roll against the others, just like toothless gears.

FIGS. 9*a* and 9*b* illustrate an embodiment in which a ball bearing 19' has a diameter equal to that of the ball bearing 20. Owing to this, the movement of this ball bearing is no longer possible, the ball bearing 29 interfering with the ball bearing 20. So as to allow for normal percussion, the ball bearing 19' is no longer activated directly by the ball bearing 29 but by means of a ball bearing 18 offset to the side. A ball bearing 19 with a large diameter increases the greasiness of the start, whereas a small diameter results in a drier, faster start. An offset ball bearing 18 is also provided if the diameter of the ball bearing 19 is smaller than that of the ball bearing 20.

Figure 10:
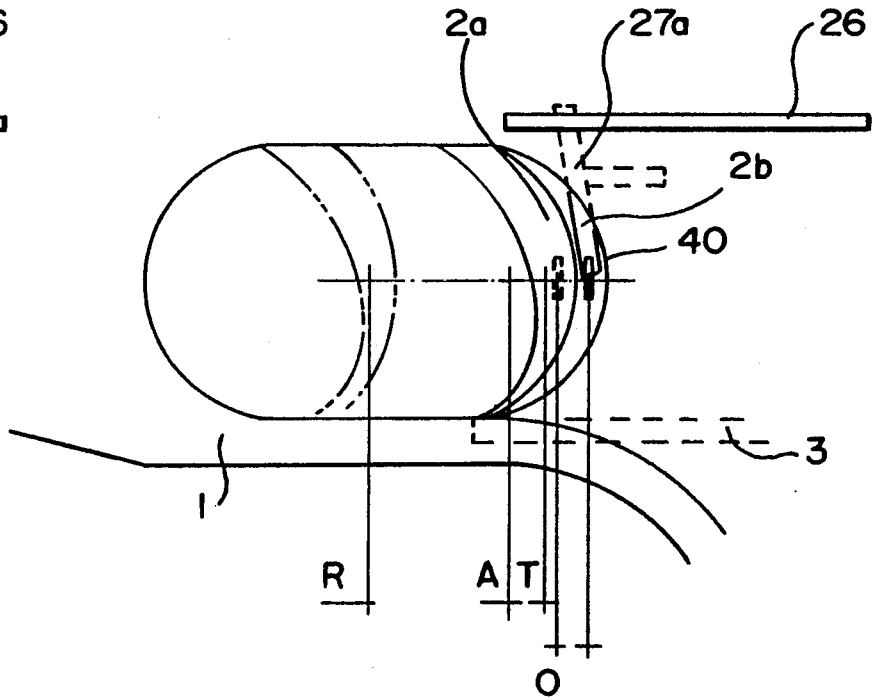
FIG. 10 shows one second embodiment of the trigger.

FIG. 10 illustrates a second embodiment of the trigger. This embodiment includes a split control, including a first trigger 2*a* able to occupy the three positions R, A and T, and a second trigger 2*b*, disposed rearwardly of the first trigger 2*a*, and preferably provided on each of its sides with a boss 40 making it possible on either side of the firearm to push the second trigger 2*b* towards so as to force the trigger 2*a* to go back to the position R. By continuing the pressure on the trigger 2*b*, it is possible to bring it to the opening position O.

The second trigger 2*b* controls the rod 26 in the same way as the annular trigger 2 of FIG. 1, that is, solely when it is desired to move to the opening position.

The system of two triggers 2*a*, and 2*b*, is more particularly envisioned for reasons of aesthetics, the triggers 2*a* and 2*b* having a more conventional shape, with the trigger guard 1 having a shorter length.

Axial play between the rod 3 and the mobile piece 5 or 5' may be provided so as to authorize a movement either towards the rear when the control rod 26 frees it, or towards the front so as to increase its travel under the action of the control rod 26 so as to open the arm and free a barrel or magazine, depending on the type of firearm.

Figure 11:
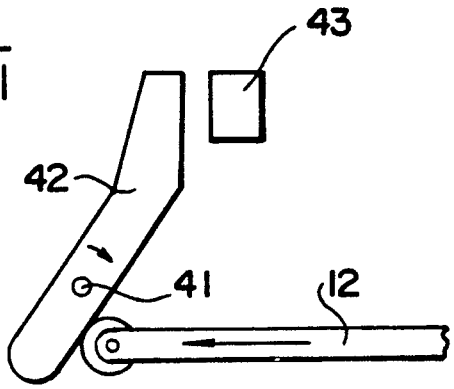
FIG. 11 illustrates a portion of a firearm comprising a triggering device activating a striking pin with a hammer.

In FIG. 11, the cock control 12 forces a hammer 42 to pivot about a fulcrum 41, causing the hammer 42 to strike a striking pin 43.

Figure 12:
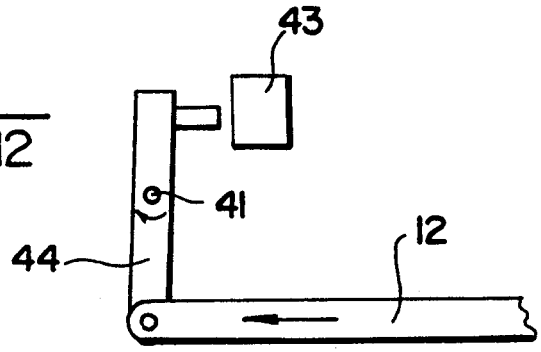
FIG. 12 illustrates a portion of a firearm comprising a triggering device for activating a striking pin with a pivoting lever.

In FIG. 12, the cock control 12 forces a pivotable lever 44 to rotate about a fulcrum 41, causing the pivotable lever 44 to engage a striking pin 43.

Figure 13:
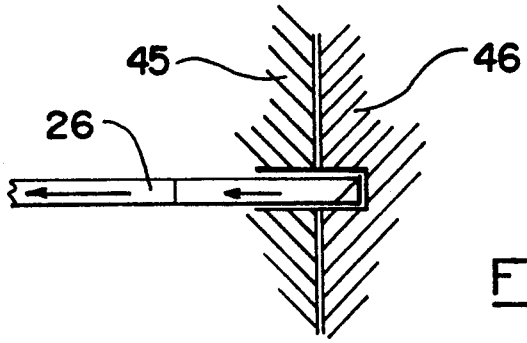
FIG. 13 illustrates a cross-sectional view of a portion of a firearm comprising a device for opening the firearm with the control rod.

In FIG. 13, the movement of the control rod 26 from the barrel 45 into a locking notch in a chamber 46, permits the locking of the firearm in a closed position.

Figure 14:
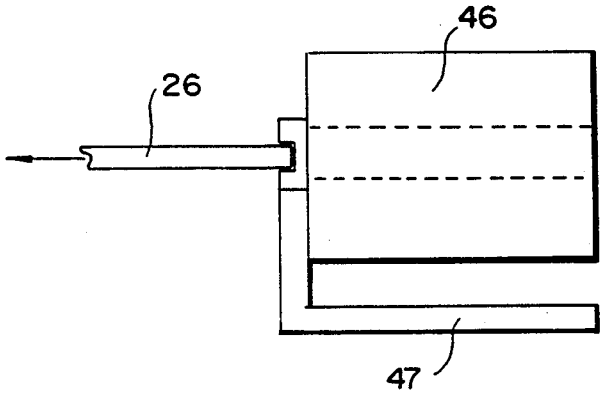
FIG. 14 illustrates a cross-sectional view of a portion of a firearm comprising a device for locking and unlocking of the barrel with the control rod.

In FIG. 14, the movement of the control rod 26 into and out of a barrel swivel pin 47 permits the locking and unlocking of the barrel 46.

Figure 15:
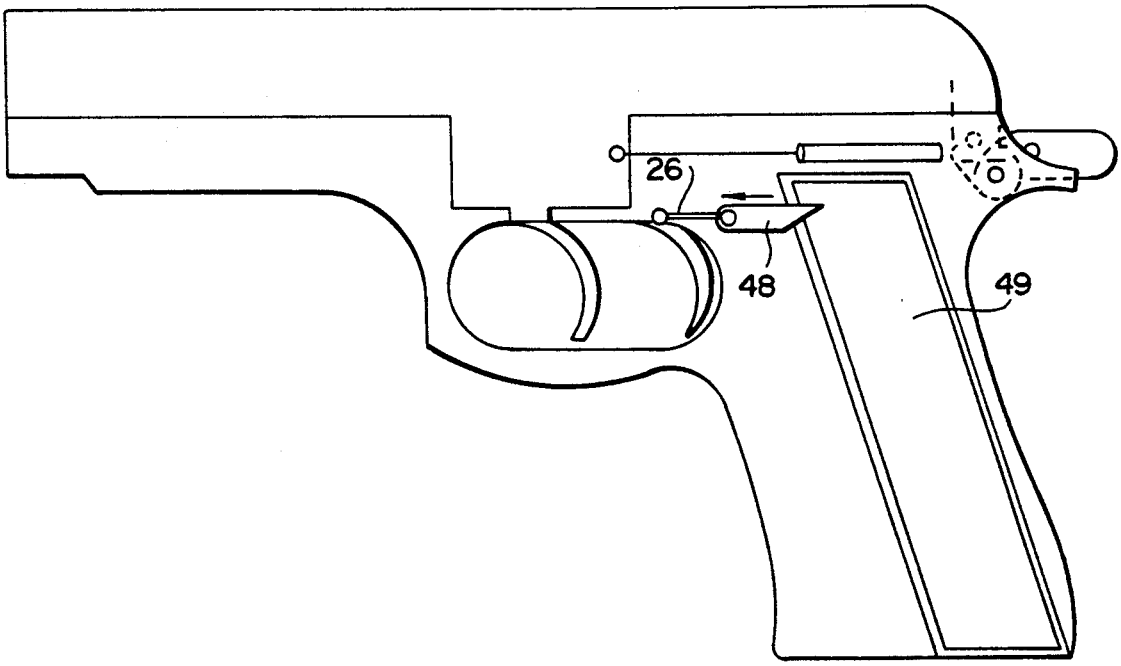
FIG. 15 illustrates a cross-sectional view of a firearm having a device for freeing a magazine with the control rod.

In FIG. 15, the movement of the control rod 26, which is connected to a latch 48, provides a device for freeing a magazine 49 with the control rod.

Finally, the invention is clearly not restricted to the embodiments illustrated and described above, but covers all possible variants.

What is claimed is:

1. A multifunctional firearm control device for a firearm, comprising:

a trigger slidably-mounted on a casing of the firearm, said trigger being capable of occupying a first position, a second position, a third position, and a fourth position, wherein:

said first position comprises a rest or uncocked position;

said second position comprises an armed position located behind said rest position;

said third position comprises a firing position located behind said armed position; and said fourth position comprises an opening position;

a triggering device comprising two meeting roller bearings and a percussion spring which, when freed, activates a hammer or striking pin;

a firing plate comprising an armament ramp on a mobile piece moved by an activation of said trigger, in a non-reversible movement after arming, by means of an armament bearing on an armament lever on said percussion spring, and a device for freeing said triggering device with meeting roller bearings; and a control rod moved by said trigger as said trigger moves into said opening position, and, depending upon the firearm type, means for controlling an opening of the firearm or an unlocking of a barrel of the firearm or a freeing of a magazine in the firearm.

2. The firearm control device according to claim 1, wherein said trigger comprises an annular member slidably-mounted in a trigger guard.

3. The firearm control device according to claim 1, wherein said trigger comprises a first trigger able to occupy said first position, said second position, and said third position, said firearm control device further comprising a second trigger disposed rearwardly of said first trigger and provided with bosses on each of its flanks so that said second trigger can be pushed forward to force said first trigger to said first position, said second trigger being able to drive said control rod into said fourth position.

4. The firearm control device according to claim 1, wherein said device for freeing said triggering device with meeting roller bearings comprises a ramp bent inwardly and integral with said armament ramp and able to come into contact with one of said roller bearings of said triggering device.

5. The firearm control device according to claim 1, wherein said control rod of said trigger is mounted free over a distance so as to disconnect said armament ramp, allowing a free rearward movement when said control rod frees said trigger, and a forward movement to open said firearm or free said barrel or said magazine, depending on said firearm type.

6. The firearm control device according to claim 1, wherein said mobile piece comprising said armament ramp is in contact with a recall spring for returning said mobile piece form firing position to said rest position.

7. The firearm control device according to claim 1, wherein said device for freeing said triggering device comprises a stecher comprising a stecher roller bearing borne by a rod integral with said armament ramp and neutralized by a retractable stop and a tilting lever controlled by a roller bearing of an armament lever when said roller bearing of said armament lever reaches said upper extremity of said armament ramp, said stecher roller bearing causing said roller bearing of said armament lever to free said triggering device.

8. The firearm control device according to claim 7, wherein said roller bearing of said armament lever has a diameter equal to or less than a diameter of a roller bearing of a cock control device, and is activated by a roller bearing offset laterally from said tilting lever.

9. The firearm control device according to claim 1, wherein said fourth position is located in front of said first position.

10. The firearm control device according to claim 9, wherein said armament bearing comprises a roller bearing and is housed at an upper extremity of said armament ramp, in a concave surface for retaining said roller bearing in two directions.

11. The firearm control device according to claim 9, wherein said armament bearing comprises a roller bearing housed at an upper extremity of said armament ramp, on a flat portion provided with a non-return retainer.

12. The firearm control device according to claim 9, wherein an armament ball bearing can be positioned on a flat portion of an upper extremity of said armament ramp, said control device further comprising a retaining device comprising a roller bearing applied by a spring against a retainer on a rod moved by said trigger.

13. A firearm control device for an automatic firearm, comprising:

a trigger slidably-mounted on a casing of the automatic firearm, said trigger being capable of occupying a first position, a second position, a third position, and a fourth position, wherein:

said first position comprises a rest or uncocked position;

said second position comprises an armed position located behind said rest position;

said third position comprises a firing position located behind said armed position; and said fourth position comprises an opening position;

a triggering device comprising two meeting roller bearings and a percussion spring which, when freed, activates a hammer or striking pin;

a firing plate comprising an armament ramp on a mobile piece moved by an activation of said trigger, in a non-reversible movement after arming, by means of an armament bearing on an armament lever on said percussion spring, and a device for freeing said triggering device with meeting roller bearings, said armament lever comprising a spindle integral with a mobile casing of said pistol, said armament ramp being integral with said casing of said automatic firearm; and a control rod moved by said trigger as said trigger moves into said opening position, and, depending upon the firearm type, and means for controlling an opening of the firearm on an unlocking of a firearm barrel of the firearm or a freeing of a magazine in the firearm.

14. The firearm control device according to claim 13, wherein an armament ball bearing can be positioned on a flat portion of an upper extremity of said armament ramp, said control device further comprising a retaining device comprising a roller bearing applied by a spring against a retainer on a rod moved by said trigger.

15. The firearm control device according to claim 13, wherein said trigger comprises an annular member slidably-mounted in a trigger guard.

16. The firearm control device according to claim 13, wherein said device for freeing said triggering device with meeting roller bearings comprises a ramp bent inwardly and integral with said armament ramp and able to come into contact with one of said roller bearings of said triggering device.

17. The firearm control device according to claim 13, wherein said control rod of said trigger is mounted free over a distance so as to disconnect said armament ramp, allowing a free rearward movement when said control rod frees said trigger, and a forward movement to open said firearm or free said barrel or said magazine, depending on said firearm type.

18. The firearm control device according to claim 13, wherein said mobile piece comprising said armament ramp is in contact with a recall spring for returning said mobile piece form firing position to said rest position.

19. The firearm control device according to claim 13, wherein said device for freeing said triggering device comprises a stecher comprising a stecher roller bearing borne by a rod integral with said armament ramp and neutralized by a retractable stop and a tilting lever controlled by a roller bearing of an armament lever when said roller bearing of said armament lever reaches said upper extremity of said armament ramp, said stecher roller bearing causing said roller bearing of said armament lever to free said triggering device.

20. The firearm control device according to claim 19, wherein said roller bearing of said armament lever has a diameter equal to or less than a diameter of a roller bearing of a cock control device, and is activated by a roller bearing offset laterally from said tilting lever.

21. The firearm control device according to claim 13, wherein said trigger comprises a first trigger able to occupy said first position, said second position, and said third position, said firearm control device further comprising a second trigger disposed rearwardly of said first trigger and provided with bosses on each of its flanks so that said second trigger can be pushed forward to force said first trigger to said first position, said second trigger being able to drive said control rod into said fourth position.

22. The firearm control device according to claim 21, wherein said device for freeing said triggering device with meeting roller bearings comprises a ramp bent inwardly and integral with said armament ramp and able to come into contact with one of said roller bearings of said triggering device.

23. The firearm control device according to claim 21, wherein said device for freeing said triggering device comprises a stecher comprising a stecher roller bearing borne by a rod integral with said armament ramp and neutralized by a retractable stop and a tilting lever controlled by a roller bearing of an armament lever when said roller bearing of said armament lever reaches said upper extremity of said armament ramp, said stecher roller bearing causing said roller bearing of said armament lever to free said triggering device.

24. The firearm control device according to claim 23, wherein said roller bearing of said armament lever has a diameter equal to or less than a diameter of a roller bearing of a cock control device, and is activated by a roller baring offset laterally from said tilting lever.

25. The firearm control device according to claim 24, wherein said control rod of said trigger is mounted free over a distance so as to disconnect said armament ramp, allowing a free rearward movement when said control rod frees said trigger, and a forward movement to open said firearm or free said barrel or said magazine, depending on said firearm type.

26. The firearm control device according to claim 25, wherein said mobile piece comprising said armament ramp is in contact with a recall spring for returning said mobile piece from firing position to said rest position.

27. A multifunctional firearm control device for a firearm, comprising:

a trigger slidably-mounted on a casing of the firearm, said trigger being capable of occupying a first position, a second position, a third position, and a fourth position, wherein:

said first position comprises a rest or uncocked position;

said second position comprises an armed position located behind said rest position;

said third position comprises a firing position located behind said armed position; and said fourth position comprises an opening position;

a triggering device comprising two meeting roller bearings and a percussion spring which, when freed, activates a hammer or striking pin; and a firing plate comprising an armament ramp on a mobile piece moved by an activation of said trigger, in a non-reversible movement after arming, by means of an armament bearing on an armament lever on said percussion spring, and a device for freeing said triggering device with meeting roller bearings; and a control rod moved by said trigger as said trigger moves into said opening position.

* * * * *

UNITED STATES PATENT AND TRADEMARK OFFICE

CERTIFICATE OF CORRECTION

PATENT NO. : 5,299,374

DATED : April 5, 1994

INVENTOR(S) : G. MATHYS

It is certified that error appears in the above-indentified patent and that said Letters Patent is hereby corrected as shown below:

On the title page, item [54] and in column 1, line 1, change "FIRE ARM" to ---FIREARM---.

At column 7, line 19 (claim 6, line 4) change "form" to ---from---.
At column 8, line 17 (claim 13, line 30) change "on" to ---or---.
At column 8, line 45 (claim 18, line 4) change "form" to ---from---.
At column 9, line 23 (claim 24, line 5) change "baring" to ---bearing---.

Signed and Sealed this

Thirteenth Day of December, 1994

*Attest:*

Bruce Lehman

BRUCE LEHMAN

*Attesting Officer*

*Commissioner of Patents and Trademarks*